US006420682B1

(12) United States Patent
Sellgren et al.

(10) Patent No.: US 6,420,682 B1
(45) Date of Patent: Jul. 16, 2002

(54) FOGLESS MIRROR FOR A BATHROOM SHOWER AND BATHTUB SURROUND

(75) Inventors: Reid Christopher Sellgren; Robert Williams Verhey, both of Minneapolis, MN (US)

(73) Assignee: NewHome Bath & Mirror, Inc., Woodbury, MN (US)

( * ) Notice: Subject to any disclaimer, the term of this patent is extended or adjusted under 35 U.S.C. 154(b) by 0 days.

(21) Appl. No.: 09/709,789

(22) Filed: Nov. 3, 2000

Related U.S. Application Data

(60) Provisional application No. 60/219,851, filed on Jul. 21, 2000, and provisional application No. 60/163,200, filed on Nov. 3, 1999.

(51) Int. Cl.[7] ..... H05B 1/00; H05B 3/00; H05B 11/00

(52) U.S. Cl. ..... 219/219; 156/232

(58) Field of Search ..... 219/217, 219, 219/531, 579, 345, 548; 172/102 R; 156/232; 362/192

(56) References Cited

U.S. PATENT DOCUMENTS

| | | | | |
|---|---|---|---|---|
| 3,160,736 A | | 12/1964 | Catterson | |
| 3,530,275 A | | 9/1970 | Rust | |
| 3,839,620 A | * | 10/1974 | Seibel et al. | 219/219 |
| 3,859,504 A | * | 1/1975 | Motokawa et al. | 219/345 |
| 3,887,788 A | * | 6/1975 | Seibel et al. | 219/219 |
| 3,959,622 A | * | 5/1976 | Bogdanov et al. | 219/549 |
| 4,422,893 A | * | 12/1983 | Ducheteau et al. | 156/232 |
| 4,665,281 A | * | 5/1987 | Kamis | 172/102 R |
| 4,940,317 A | | 7/1990 | Reuben | |
| 4,956,542 A | * | 9/1990 | Prosser | 219/219 |
| 5,302,809 A | | 4/1994 | Ghiassy | |
| 5,380,981 A | | 1/1995 | Feldman et al. | |
| 5,406,049 A | | 4/1995 | Reiser et al. | |
| 5,408,069 A | * | 4/1995 | Mischell, Jr. | 219/219 |
| 5,412,181 A | * | 5/1995 | Giamati | 219/548 |
| 5,414,241 A | * | 5/1995 | Ohashi et al. | 219/219 |
| 5,904,874 A | | 5/1999 | Winter | |
| 6,036,333 A | * | 3/2000 | Spiller | 362/192 |
| 6,147,333 A | * | 11/2000 | Matson | 219/531 |

* cited by examiner

*Primary Examiner*—Joseph Pelham
*Assistant Examiner*—Leonid M Fastovsky
(74) *Attorney, Agent, or Firm*—Patterson, Thuente, Skaar & Christensen, P.A.

(57) ABSTRACT

A fogless heated mirror for incorporation into a shower surround, bathtub surround, whirlpool surround, sauna surround and any other similar surround that may be exposed to direct contact with water or a very high concentration of steam. The fog-free mirror 10 of the present invention for incorporation into a shower or tub surround 12 generally includes a mirror 14, a heater pad 16, and an electrical connection assembly 18.

21 Claims, 5 Drawing Sheets

FOGLESS MIRROR FOR A BATHROOM SHOWER AND BATHTUB SURROUND

CROSS-REFERENCES TO RELATED APPLICATIONS

This application claims priority to and incorporates by reference the entire contents of both, U.S. Provisional Application No. 60/163,200 filed Nov. 3, 1999, and U.S. Provisional Application No. 60/219,851 filed Jul. 21, 2000.

FIELD OF THE INVENTION

The invention relates to heated mirrors for the prevention of fogging in a high-humidity environment. More particularly, the present invention relates to a fogless heated mirror for incorporation into a shower surround, bathtub surround, whirlpool surround, sauna surround and any other similar surround that may be exposed to direct contact with water or a very high concentration of steam.

BACKGROUND OF THE INVENTION

Ambient air includes a certain amount of water vapor amongst other gases. The amount of water vapor that ambient air can hold is dependent, in part, upon the temperature of the ambient air. Dew point is a measure of the temperature at which water vapor in ambient air will begin to fall out and condense upon a surface. In situations of high humidity such as a bathroom where a shower or other hot water sources are present, it is common for the dew point to be higher than the surface temperature of structures in the bathroom, such as the mirror. When the temperature of a mirror or other surface is below that of the dew point, water vapor from the ambient air will condense onto the surface of the mirror causing fogging.

One way to prevent condensation and fogging on a mirror is to maintain the surface of the mirror at a temperature higher than that of the dew point. This is most conveniently done by providing a source of heat to the mirror.

Heated mirrors have long existed in the art. Heated mirrors have fallen into two basic classifications. The first classification includes those mirrors that are heated by hot water drawn from the bathroom plumbing system. Heating a mirror by using hot water from the bathroom plumbing system has the obvious disadvantage in that the plumbing required might be complex and is subject to the risk of leaking.

The alternative approach is to heat the mirror by the use of electrical heating elements. Examples of such mirror, which utilize electrical heating elements, are described in the following prior art references: U.S. Pat. No. 3,160,736 issued to Catterson, U.S. Pat. No. 5,302,809 issued to Ghiassy, U.S. Pat. No. 5,280,981 issued to Feldman et al., and U.S. Pat. No. 5,408,069 issued to Mischel. All of the previously cited references disclose electric heating elements that are connected to an electrical source, which are secured to the backs of mirrors or wall behind the mirror for defogging them. However, all of these references fail to adequately protect the heating element and electrical connections from exposure to moisture or require additional materials used in combination with the element to uniformly heat the mirror surface.

Other prior art references disclose or suggest fogless mirrors, but do not provide a moisture resistant assembly for the protection of the heating element and electrical connections. For example, U.S. Pat. No. 5,406,049 issued to Reiser et al., discloses a fog-resistant mirror assembly including a conductive coating within the mirror thereby providing a heating element. Additionally, U.S. Pat. Nos. 3,530,275 and 4,940,317 issued to Rust and Reuben, respectively, disclose resistant heating elements secured to mirrors per se. Furthermore, U.S. Pat. No. 5,904,874 issued to Winter, discloses a resistance heating device that is incorporated as a plurality of layers in a bathroom mirror. Finally, U.S. Pat. No. 5,911,896 reveals a thin film heater element that can be laminated between two glass ceramic panels.

It is noted that the prior art references cited above are not specifically designed to be used in an environment where direct exposure to flowing water may occur. The devices disclosed in the previously mentioned references fail to provide a heating element adequately sealed from outside moisture. Furthermore, the previously cited references do not disclose a heating element enclosed in a moisture insulation assembly that will not absorb moisture or deteriorate when in contact with moisture, but still possesses the capability of uniformly and controllably transferring heat to a mirror surface. In particular, none of the known prior art is designed specifically for use in a shower or bathtub surround.

In recent years, architectural trends have moved toward the development of larger, more comfortable, more luxurious bathrooms in residential construction. These architectural trends have been in response to changes in lifestyle in which bathrooms have often changed from purely utilitarian areas to areas of greater convenience and luxury. For example, bathrooms in new construction and remodeling now often incorporate hot tubs or whirlpool tubs as well as luxury shower facilities. Along with these changes has been a general trend toward increasing convenience items in bathroom facilities. Thus, it is now more desirable than in the past to be able to have a fog-free mirror incorporated into a luxury shower or tub surround to accommodate such activities as shaving, hair coloring and other cosmetological activities. With this desire comes an increased concern for absolute electrical safety since the fog-free mirror may be exposed directly to water, more than a typical vanity mirror.

In addition, with the aging of the population, a mirror incorporated into the bathtub or shower surround presents enhanced convenience and also provides accommodations to certain types of disabilities. For example, persons with arthritis may find it much more comfortable to do fine motor tasks such as shaving in a warm moist environment. Therefore, the placement of a fog-free mirror in a shower or bathtub surround accommodates individuals with such conditions.

SUMMARY OF THE INVENTION

The fogless mirror of the present invention overcomes many of the above problems and fulfills most of the above desires by providing an electrically heated mirror that is extremely safe even in a very wet environment. Further, the mirror of the present invention accommodates use as a dedicated factory installation into a shower or tub surround as well as allowing for a fogless mirror to be retrofit to an existing shower or tub surround.

The fog-free mirror of the present invention generally includes an electrical heating element sealed into a multi-layered water resistant composite pad and operably connected to a special water-resistant electrical plug connector for connection of the mirror to an electrical power supply. The fog-free mirror is available in a low voltage configuration in a first embodiment as well as a second embodiment that operates on standard residential current. The sealed heating element of the present invention is secured to the back of a standard back silvered mirror by a pressure-sensitive adhesive.

DETAILED DESCRIPTION OF THE INVENTION

Figure 2:
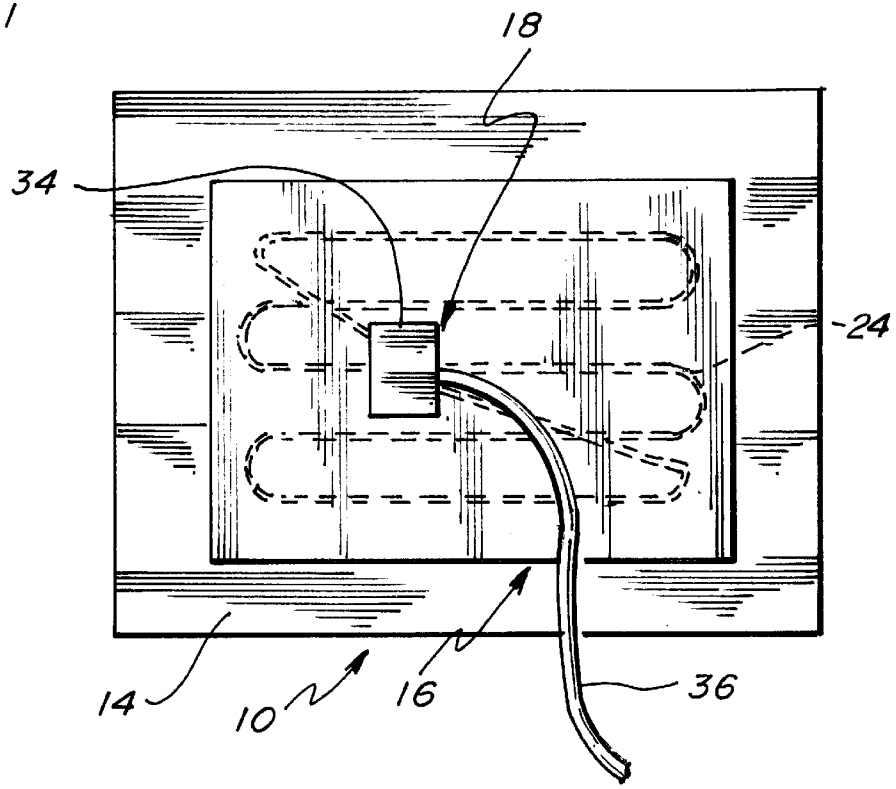
FIG. 2 is a schematic drawing of an embodiment of the fogless mirror showing the incorporated heating pad.
Figure 1:
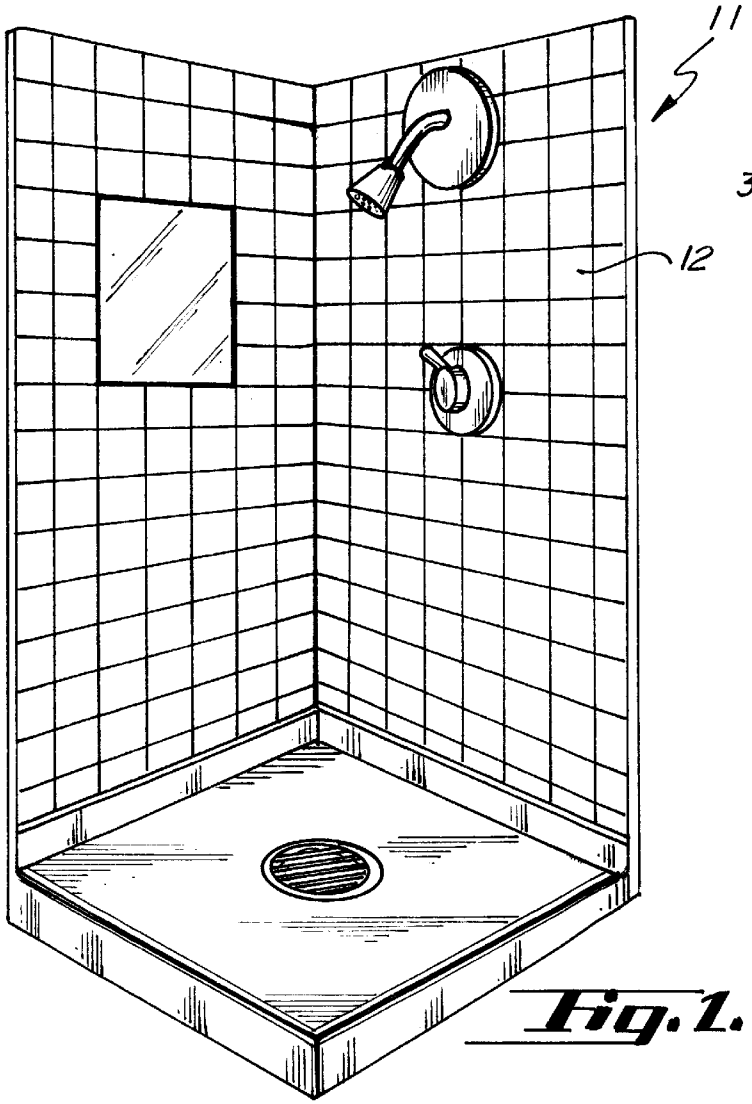
FIG. 1 is a perspective view of an embodiment of the fogless mirror incorporated into a bathroom shower surround.
Figure 3:
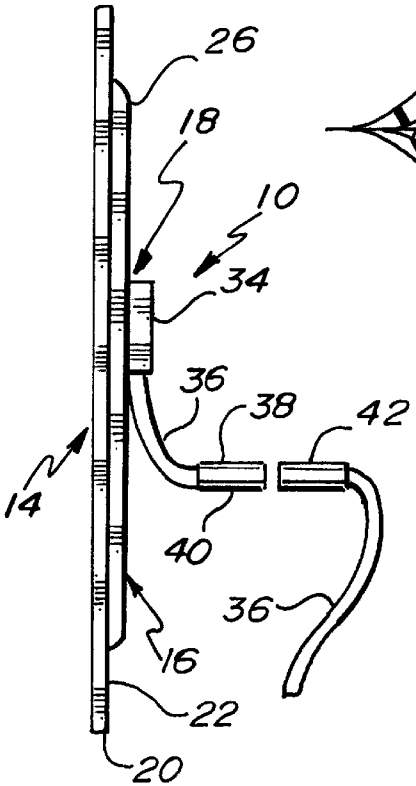
FIG. 3 is an edge elevation of an embodiment of the mirror and heating pad assembly.

Referring to FIGS. 1, 2 and 3, a fogless mirror shower assembly 11 includes the components of a fogless mirror assembly 10 and a shower surround 12. It is noted that shower surround 12 may include a bathtub surround, whirlpool surround, sauna surround and any other similar surround that may be exposed to direct contact with water or a very high concentration of steam. The normal bathroom setting, such as the areas including vanity mirrors or the like, is not contemplated as being an area of high steam concentration as defined above. One embodiment of the present invention depicted in FIG. 1 illustrates two of the four walls of a shower surround. The other two walls generally include another wall, similar to that depicted in FIG. 1 and a door assembly. The door assembly is generally a waterproof door or a shower curtain. The fog-free mirror 10 of the present invention for incorporation into a shower or tub surround 12 generally includes a mirror 14, a heater pad 16, and an electrical connection assembly 18.

The fog-free mirror 10 is generally secured to any type of shower or bathtub surround 12. Shower or bathtub surrounds 12 comprising tile, fiberglass, porcelain, or any other material utilized in such surrounds are easily adaptable to accommodate a fogless mirror 10. Embodiments the fog-free mirror 10 may be incorporated into a shower or bathtub surround 12 in the manufacturing process or the fog-free mirror 10 may be made available for after-market installation in existing shower surround 12. However, many of embodiments of the present invention include heater and mirror combinations which are intended to be installed directly within bathroom shower surrounds and are intended as permanent constructions.

The mirror 14 of the fogless mirror 10 may be of any type, but preferably includes a transparent substrate 20 and a reflective coating 22. In one embodiment the mirror 14 is a glass mirror with a back silvering wherein the dimensions are 12" by 10" by ¼". However, the shape and dimensions of the mirror can vary as desired. For example, mirror 14 may be generally rectangular, square, triangular, circular, oval, polygonal or irregular in shape.

The fog-free mirror 10 also includes a heater pad 16. The heater pad 16 generally includes a heater element 24 and a moisture insulation assembly 26. In one embodiment the heater element 24 comprises a multitude of operably connected wires made of high temperature nickel chromium alloy, preferably of highest quality A wire which is 80% nickel and 20% chrome tested to 2000° F. However, the heating element 24 may comprise any electrically conductive material suitable for the present invention.

According to one embodiment of the present invention as depicted in FIGS. 2, 4–6 and 8, the heater pad 16 is centered and adhered to the mirror with a pressure-sensitive adhesive (not shown). An example of such a pressure sensitive adhesive is 3M Scotch Hi Temperture Acrylic Adhesive produce by Minnesota Mining & Manufacturing Corporation. In such an embodiment, the heater pad 16 may include a moisture resistant insulation assembly 26 with an enclosed resistance heating element 24 routed through the moisture insulation assembly 26.

The moisture insulation assembly 26 of one embodiment comprises two or four layers which include but not limited to one or more of the following materials: silicone, fiberglass, silicone composite materials, fiberglass composite materials, or other similar materials. For example in various embodiments of the present invention layers may comprise a silicone material with fiberglass strands impregnated within the silicone material. The strands of fiberglass provide strength and stability to overall material.

Figure 4:
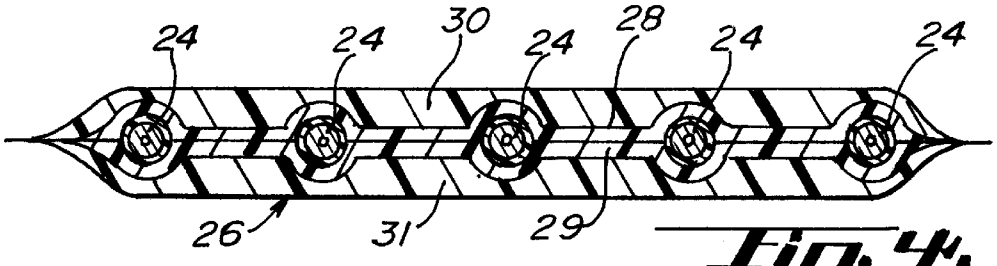
FIG. 4 is a cross-sectional view of one embodiment of the heating pad assembly.

FIG. 4 depicts an embodiment which includes four layers. The first two layers 28, 29 are inner layers positioned on either side of the heating element and are made of a silicone and fiberglass composite. The two layers 28, 29 are fused together thereby encapsulating the heating element 24 within and providing a uniform surface for transference of heat generated by the heating element 24. Each inner layer 28–29 is generally 5–25 mils thick, preferably about 15 mils thick. However, the size and composition of the heating element 24 and materials utilized in the inner layers 28, 29 will dictate the thickness needed to provide optimum function of the fogless mirror 10. The present embodiment also includes two outer layers 30, 31 made of a similar material as the inner layers 28, 29, such as pure silicone. The two outer layers 30, 31 of this embodiment are generally about 10–30 mils thick, preferably 20 mils thick and fused together over the inner layers 28, 29. Again, the thickness will vary depending upon the factors considered above.

Figure 5:
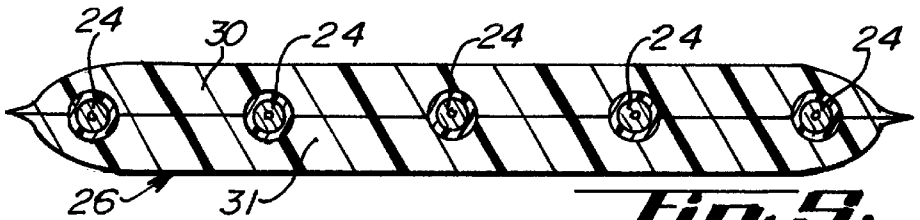
FIG. 5 is a cross-sectional view of an alternate embodiment of the heating pad assembly.

Another embodiment of the present invention, as depicted in FIG. 5, comprises only two outer layers 30, 31 and omits inner layers 28 and 29. The two outer layers 30, 31 of this embodiment may include, but are not limited to, silicone, fiberglass, silicone composite materials, fiberglass composite materials, or other similar materials and are generally fused together. A preferred embodiment may include the two outer layers 30, 31 comprising silicone or a silicone material impregnated with strands of fiberglass as described above. According to another embodiment, a thick film polymer may be used, made of etched-foil-type heating elements fused between layers of a polymeric material.

Figure 6:
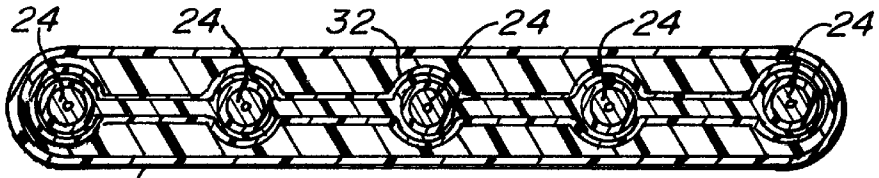
FIG. 6 is a cross-sectional view of an alternate embodiment of the heating pad assembly, which includes multiple bladders.
Figure 8:
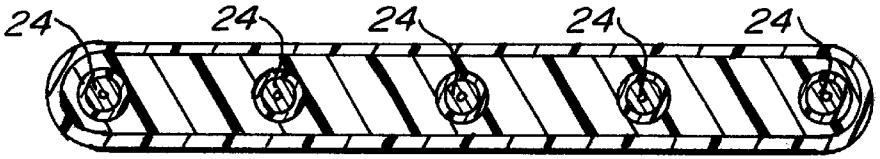
FIG. 8 is a cross-sectional view of an alternate embodiment of the heating pad assembly, which includes a bladder.
Figure 7:
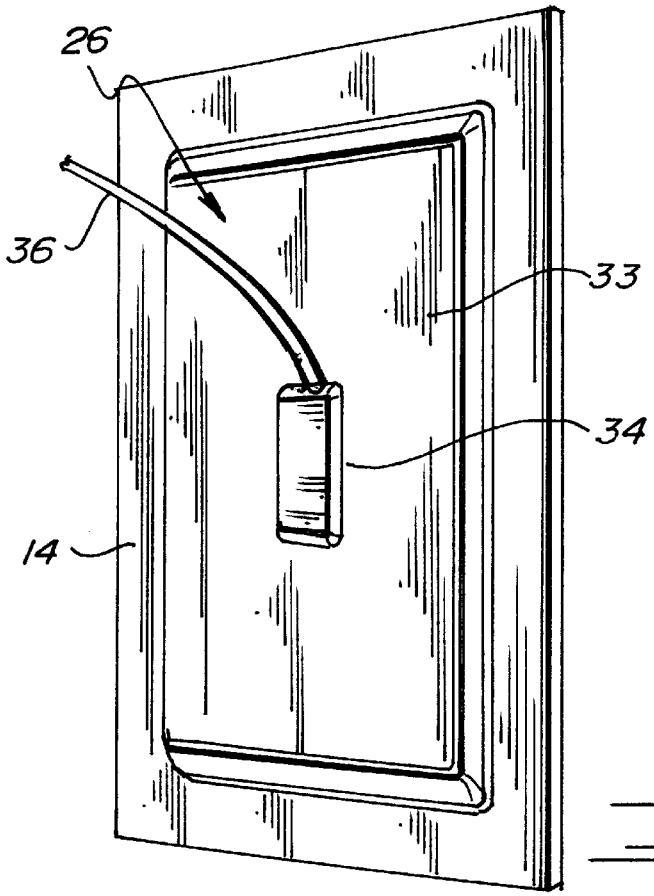
FIG. 7 is a perspective back view of an embodiment of the fogless mirror.
Figure 9:
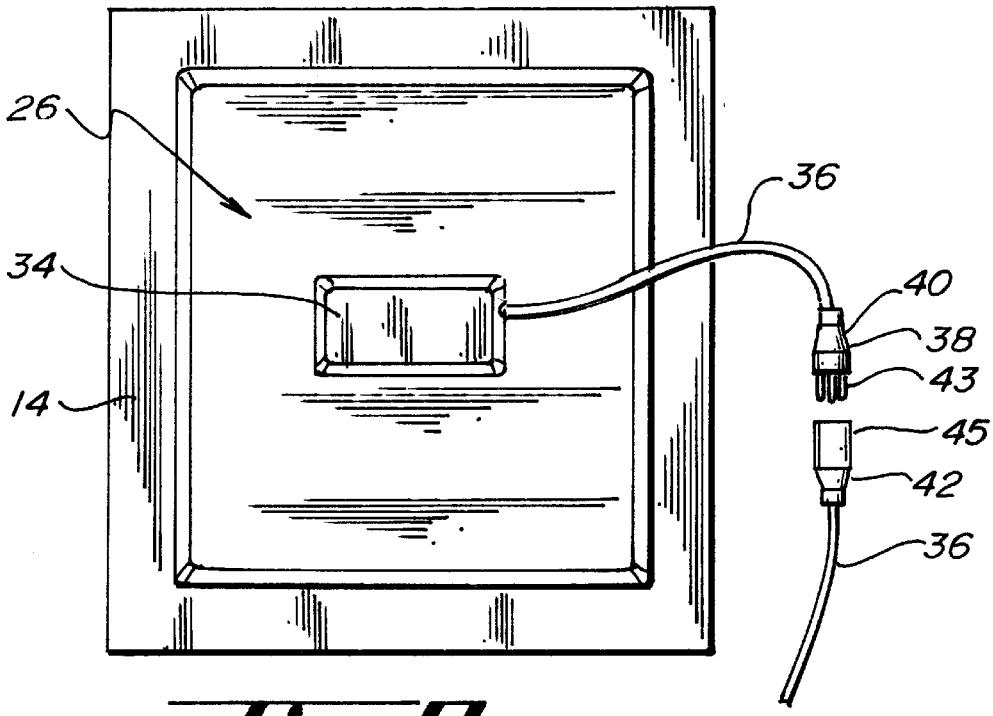
FIG. 9 is a perspective view of an embodiment of the fogless mirror, which includes first and second electrical connectors.
Figure 10:
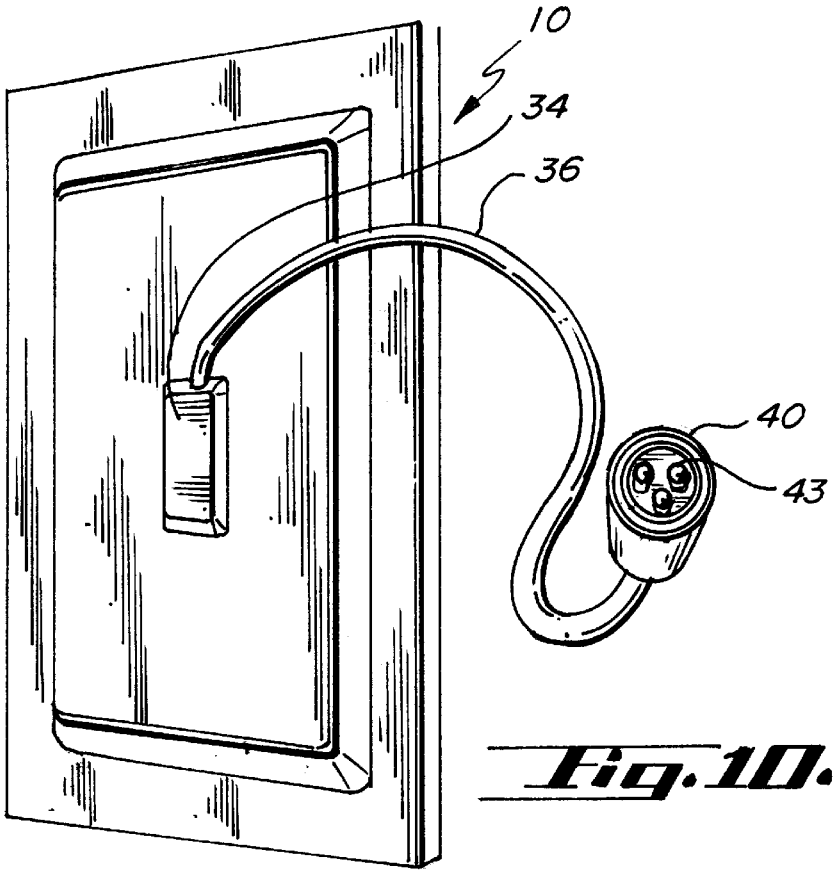
FIG. 10 is a perspective view of an embodiment of the fogless mirror, which includes a depiction of a female electrical connector.

Referring to FIG. 6, another embodiment of the present invention includes a moisture insulation assembly 26 comprising an inner moisture insulated bladder 32 and an outer insulated bladder 33. The inner insulated bladder 32 and outer insulated bladder 33 may be comprised of silicone, fiberglass, silicone composite materials, fiberglass composite materials, or other similar materials. A preferred embodiment may comprise an inner layer 32 that is made of a silicone/fiberglass composite and an outer layer 33 made of silicone. In another embodiment, both bladders 32 and 33 may be made of pure silicone. In either embodiment the inner insulated bladder 32 completely surrounds and encloses the heating element 24 aside from where electrical connection assembly 18 connects to the heating element 24. Outer insulated bladder 33 then entirely encapsulates inner insulated bladder 30 and its contents, again aside from where electrical connection assembly 18 connects to the heating element 24. It is noted that a junction box 34 of the electrical connection assembly 18, as depicted in FIG. 7 may be a unitary portion of the outer insulated bladder 33. In an additional embodiment of the invention depicted in FIG. 8, inner insulated bladder 32 is omitted and outer insulated bladder 33 is utilized to encapsulate the heating element 24.

Some embodiments of the heating pad 16 can be designed to handle 6, 12, 24, 110/120, 220/240 or 127 volts and generate 1–100 watts. Other voltages and wattages are contemplated. In one embodiment the center of the pad 16 provides a connection point for the conductor wires 36 of a moisture-resistant electrical connection assembly 18, to be described. The connection point of the electrical connection assembly 18 preferably is molded-in, with a build-up of pure silicon or other water resistant material. As previously mentioned, the face of the pad 16 can have a pressure-sensitive adhesive with a clear protective and removable cover.

The fogless mirror 10 of the present invention also includes an electrical connection assembly 18 as depicted in FIGS. 2, 3 and 9–10. Water-resistant connectors are incorporated into the embodiments of the present invention, e.g. dual-keyway plugs, water resistant wiring and cable assemblies. The electrical connection assembly 18 depicted in FIGS. 2, 3 and 9–10, generally includes a junction box 34, conductor wires 36 and connectors 38. Junction box 34 is integrally sealed to inner layers 28, 29 and outer layers 30, 31 or to inner insulated bladder 32 and outer insulated bladder 33. Junction box 34 is further seals conductor wires 36. Junction box 34 and conductor wires 36 are entirely sealed to create a multi-layered water-tight seal along a sufficient length to remove any electrical current from exposure to moisture. Connectors 38 are connected at some length from junction box 34 to conductor wires 36. Connectors 38 preferably comprise a first connecter 40 and a second connector 42. First connector 40 and second connector 42 are preferably configured so that when they are connected to one another a water-tight seal is formed. First connector 40 and second connector 42 may comprise a female connector 43 with a mating male connector 45 or may comprise connectors (not shown) which are identical but mate to create a continuous electrical connection.

As previously mentioned embodiments of the electrical connection assembly 18 may include a male waterproof connector, which extends from the back of the unit and a male waterproof connector that extends from the power supply receptacle. Embodiments of the male and female plugs may be both manufactured of e.g. 2 or 3–18 AWG: PVC insulated, metallic braid, stranded copper conductors, e.g. yellow jacketed, 300 v AWM 2661, 105° C., UL recognized. The UL component number, according to one embodiment, is UL #E152210. The approximate length of the female connector from the heater is about 2–36", according to one embodiment, and the approximate length of the male supplied cord may be up to 50' in length, for example. This product part may be substituted for by parts of equal or better construction.

Figure 11:
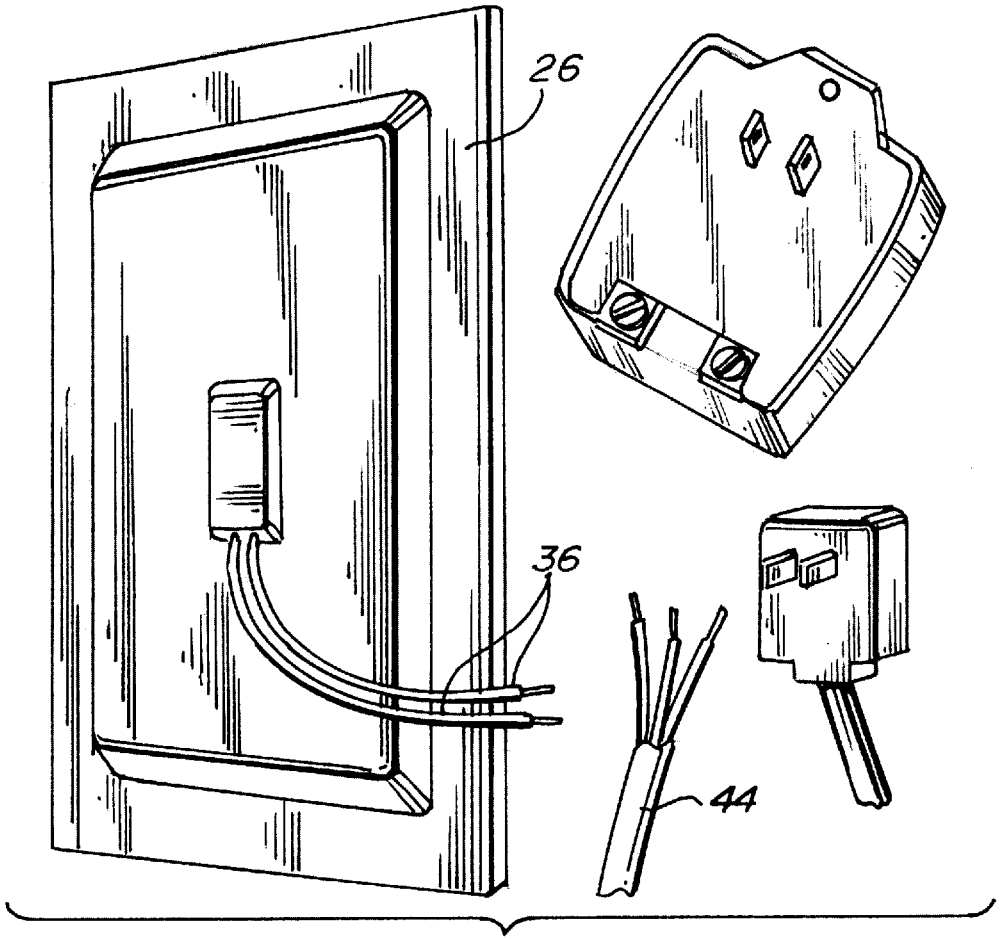
FIG. 11 is a perspective back view of an embodiment of the fogless mirror, which includes an alternate electrical connection assembly.

Another embodiment of the present invention may include an electrical connection assembly 18 wherein the conductor wires 36 may be hard wired into the household electrical supply 44 directly. FIG. 11 depicts an embodiment of the present invention which may be wired into the household electrical supply 44. The fogless mirror 10 depicted in FIG. 11 includes conductor wires 36, which are adjoined to the moisture insulation assembly 26 so as to not expose the electrical current from the conductor wires 36 or the heating element (not shown) to moisture. Embodiments of the present invention connected directly to the household electrical supply 44 may be connected, for on and off control, to the switch of a light, fan or any other electrical switch. Furthermore, embodiments of the present invention may utilize the faucet controls of the shower or bathtub as an on/off switch to begin or terminate electricity flow to the heater pad 16.

The present invention also includes embodiments which require low-voltage for operation. To increase the safety factor associated with the invention, in keeping with UL standards, for example, embodiments of the invention provide 12 volts or 24 volts to the mirror instead of e.g. 110 volts or 220 volts. However, as previously suggested, embodiments of the invention may be direct-wired to, already installed, wiring connected to a transformer, battery, or other suitable device.

Figure 12:
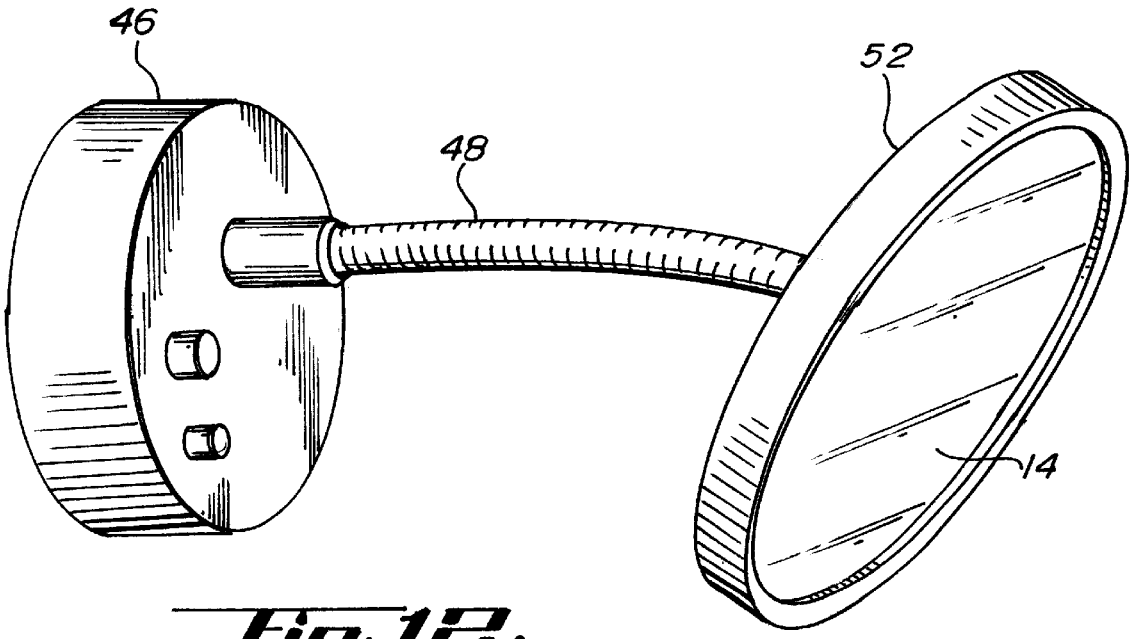
FIG. 12 is a perspective view of an additional embodiment of the fogless mirror.
Figure 13:
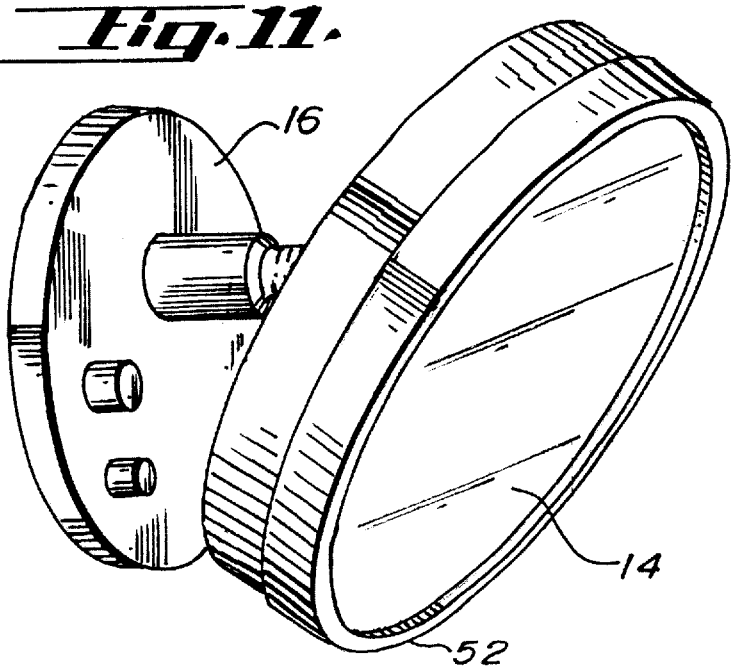
FIG. 13 is a perspective view of an embodiment of the mirror assembly included in the fogless mirror of FIG. 12.

FIGS. 12 and 13 depict an embodiment of the present invention positioned in a shower surround 12 which is battery-powered. This embodiment includes a base 46, a flexible stem 48, and a mirror assembly 50. Of course, stem length, mirror size, base shape, base components and/or finish may vary, according to embodiments of the invention. The base 46 of this embodiment may be affixed to the shower surround 12 by any type of attaching means (not shown) such as adhesive, screws, clamps or other similar attaching devices. The base 46 is sized and shaped to accommodate a battery (not shown) within. The flexible stem 48 is configured shaped and sized to house the conductor wires 36. Finally the mirror assembly 50 includes a mirror 14, a housing 52 and a heater pad 16. The housing 52 supports the mirror 14 and the heater pad 16. The mirror 14 and heater pad 16 are similar to the mirror and heater pad described above, but are configured to fit within the housing 52. It is noted that the embodiment depicted in FIGS. 12 and 13 may be adapted to accommodate any electrical source including hard wiring such an embodiment to the household electrical supply 44.

Alternately, the fog-free mirror 10 may be configured so as to receive its electrical supply through a step down transformer. In transformer or battery operated embodiments of the invention, the heating element 24 may be configured for operation on six, twelve or twenty-four volts or any other convenient voltage level. Generally, fog-free mirror 10 will be constructed to produce 14–25 watts of heat, though heat output may be adjusted as appropriate for local conditions.

Regarding installation, various embodiments of the shower mirror assembly 19 are designed to be powered by an existing circuit, and turned on whenever a switch, such as the bathroom light or fan, is turned on. Additionally, installation may call for wiring the heater pad 16 to an appropriate AC or appropriate DC power supply, such as a 12- or 24-volt supply.

The fogless mirror 10 should be connected to the appropriate power supply (not shown) in accordance with all applicable safety, national and local electrical codes. All wiring between the mirror heater and the electrical switch junction boxes must be installed per the local and national electrical codes using a wiring system identified by the National Electrical Code.

The tools recommended for installation of embodiments of the present invention are as follows: Flashlight, 2 wire nuts, 1 low-voltage remodel junction box, utility knife, wire strippers, regular screwdriver, tape measure, drywall saw or router, electrical tape, mirror mastic, caulk, and pliers.

Before installing embodiments of the present invention in wall board or tile surround the following cautions and instructions should be followed:

1. Use caution with all electrical appliances.
2. Do not bend, alter, submerge in water, or use product for purposes other than described.
3. If doubts concerning the electrical connection arise, consult a qualified electrician.
4. Mirror 14 must be larger the heater pad 16.

To begin installation it is recommended that the height of the desired position of the fogless mirror 10 in the shower surround 12 be first measured and marked from the finished shower floor. Next, determination of whether the fogless mirror 10 will be installed horizontally or vertically in a wall of the shower surround 12 should be ascertained. The dimensions for installation should be adjusted accordingly for alternative fogless mirror 10 sizes and shapes.

Once the location of the height of the fogless mirror is determined, an 'X' should be marked on the stud where the top of the fogless mirror 10 will be installed, this location will be called the fogless mirror height. The next step is to measure the mark approximately 5" down from the fogless mirror height for horizontal placement and measure and mark approximately 6" down from the fogless mirror height when considering vertical placement. This height of such a mark will vary depending on the size and shape of the fogless mirror 10. The junction box 34 will be centered in the measured spot below the fogless mirror height and positioned directly behind the heater connectors 36 such that they can be stowed the wall of the shower surround. The location and dimensions of this spot should be recorded for later access to the electrical connection assembly 18. Next, be sure the power to the circuit to which the heater is to be connected is turned off at the disconnect means.

Following determination of the above described junction box position on the wall, an opening in the wall of the shower surround sufficient to accommodate the insertion of the electrical connection assembly 18 must be created. This opening may already be existing or may be cut into existing wall using any type of sawing device. It is also contemplated that an opening in the wall or tile may be created to accommodate the entire fogless mirror 10. This would allow for the fogless mirror 10 to be grouted or caulked into the desired position.

Once the proper opening has been created a power supply wire (not shown), such as a wire from a switched 12- or 24-volt power supply or from the house electrical supply, is operably connected to the electrical connection assembly 18. It is noted that the electrical specifications of the power supply should be checked to insure the wall switch is suitably rated for the combined maximum lighting load and load of heater type. This may be accomplished by performing the following calculation: add total maximum wattage of each lamp holder, divided by voltage and add to specific heater amperage. The total amperage must not exceed rating of wall switch (i.e. 15-amp switch).

Next, the fogless mirror is centered either vertical or horizontal over the opening and taped into place. It is recommended that the fogless mirror be squared or properly positioned before permanent securing. Once the fogless mirror is squared or properly positioned, ceramic tile or other appropriate shower surround surfacing is installed to the edges of the fogless mirror. Once the surrounding surface is installed the fogless mirror is secured to the shower surround. This may be done by utilizing an adhesive, grout, caulk or any other suitable means for adequately securing the fogless mirror into position. It is noted that any approved mirror mastic may be utilized to hold mirror in place. However, it is suggested not to apply silicone or other aggressive adhesives to mirror backing. This may cause damage to silvering.

Finally, once the fogless mirror is placed into its location and all connectors are positioned into proper receptacles, the edges of the fogless mirror may be further sealed in relation to the wall of the shower surround with a material such as caulk, to provide additional moisture resistance protection for the electrical connection assembly 18 and the heating element 24.

As mentioned previously, the fogless mirror shower assembly 11 operates to provide a fogless mirror 10 that is water resistant and will not fog over upon exposure to a high moisture area. In operation, the initiation of a power supply by turning on a switch or alternatively turning on a water faucet provides an electric current to the heating element. The heating element warms the moisture insulation material, which transmits heat to the mirror. As previously mentioned the moisture insulation material includes materials, which uniformly conducts and transfers heat to the surface of the mirror. The transfer of heat to the surface of the mirror provides for the temperature of the mirror to be higher than the dew point, thereby preventing the fogging of the mirror.

In summary, activating the electrical supply to the bathroom or other room in which the mirror is mounted, for example by turning on the light or turning on the water, powers up the pad, heating it and the mirror and thereby preventing steam from condensing on the mirror surface. This creates a generally fog-free mirror.

While the invention has been described with reference to specific embodiments, the description is intended to be illustrative and is not to be construed as limiting the scope of the invention. For example, various shapes, dimensions, materials and other features of the invention can be changed or modified to suit a particular application and are not limited necessarily to those described herein. Various modifications and changes may occur to those skilled in the art without departing from the spirit and scope of the invention.

What is claimed is:

1. A fogless mirror shower assembly, comprising a shower surround including one or more fogless mirror assemblies; said fogless mirror assemblies comprising:

a mirror;

a heater pad adjoined to a back surface of the mirror, said heater pad including one or more heating elements and a moisture resistant insulation assembly, wherein said moisture resistant insulation assembly comprises two or more water resistant layers are fused together around the heating element to protect the heating element from moisture; and a water resistant electrical connection assembly including one or more moisture insulated conductor wires operably adjoined to the heating element and a power supply.

2. The fogless mirror shower assembly of claim 1, wherein said mirror comprises a transparent substrate and a reflective coating.

3. The fogless mirror shower assembly of claim 1, wherein the water resistant layers include a material selected from the group consisting of silicone, fiberglass, silicone composite materials, and fiberglass composite materials.

4. The fogless mirror shower assembly of claim 1, wherein the water resistant layers comprise a material of silicone impregnated with strands of fiberglass.

5. The fogless mirror shower assembly of claim 1, wherein said moisture resistant insulation assembly includes one or more bladders which substantially encloses said heater element.

6. The fogless mirror shower assembly of claim 1, wherein said moisture resistant insulation assembly includes an inner bladder and an outer bladder, said inner bladder substantially encloses the heating element heater and the outer bladder encloses both the inner bladder and the heating element.

7. The fogless mirror shower assembly of claim 1, wherein the electrical connection assembly includes a male connector and a female connector.

8. The fogless mirror shower assembly of claim 1, wherein the power supply is a supply selected from the group consisting of a transformer, a battery source or a household electrical supply.

9. The fogless mirror shower assembly of claim 1, wherein the power supply to the fogless mirror is initiated and terminated by a fan or light switch.

10. The fogless mirror shower assembly of claim 1, wherein the power supply to the fogless mirror is initiated and terminated by a water faucet.

11. A self-contained fog resistant mirror for use in a shower surround, the self-contained fog resistant mirror comprising:

a mirror;

a heater pad adjoined to a back surface of the mirror, said heater pad including one or more heating elements and a moisture resistant insulation assembly;

a frame operably attached to the mirror;

a battery power source mounted in the frame and operably connected to the heater pad; and a water resistant electrical connection assembly including one or more moisture insulated conductor wires operably adjoined to the heating element and a battery power source.

12. The fog resistant mirror as claimed in claim 11, wherein said mirror comprises a transparent substrate and a reflective coating.

13. The fog resistant mirror of claim 11, wherein said moisture resistant insulation assembly comprises two or more water resistant layers are fused together around the heating element to protect the heating element from moisture.

14. The fog resistant mirror of claim 13, wherein the water resistant layers include a material selected from the group consisting of silicone, fiberglass, silicone composite materials, and fiberglass composite materials.

15. The fog resistant mirror of claim 13, wherein the water resistant layers comprise a material of silicone impregnated with strands of fiberglass.

16. The fog resistant mirror of claim 11, wherein said moisture resistant insulation assembly includes one or more bladders which substantially encloses said heater element.

17. The fog resistant mirror of claim 11, wherein said moisture resistant insulation assembly includes an inner bladder and an outer bladder, said inner bladder substantially encloses the heating element heater and the outer bladder encloses both the inner bladder and the heating element.

18. A method of installing a fogless mirror in a shower surround comprising:

fabricating a fogless mirror comprising a mirror, a heater pad, and a water resistant electrical connection assembly, wherein the heater pad is adjoined to a back surface of the mirror, wherein the heater pad includes one or more heating elements and a moisture resistant insulation assembly, and wherein the water resistant electrical connection assembly includes one or more moisture insulated conductor wires operably adjoined to the heating element and a power supply;

measuring and marking a spot for installation of the fogless mirror on a wall of the shower surround;

creating an opening in the wall of the shower surround of a size sufficient to accommodate a portion of or the entire fogless mirror;

connecting the fogless mirror to the power supply;

securing the fogless mirror to the wall of the shower surround; and sealing the fogless mirror in relation to the wall of the shower surround to provide additional protection from undesired moisture.

19. The method of installing a fogless mirror of claim 18, wherein the power supply is a supply selected from the group consisting of a transformer, a battery source or a household electrical supply.

20. The method of installing a fogless mirror of claim 18, wherein the power supply to the fogless mirror is initiated and terminated by a fan or light switch.

21. The method of installing a fogless mirror of claim 18, wherein the power supply to the fogless mirror is initiated and terminated by a water faucet.

* * * * *

US006420682C1

(12) EX PARTE REEXAMINATION CERTIFICATE (9273rd)

United States Patent
Sellgren et al.

(10) Number: US 6,420,682 C1
(45) Certificate Issued: Sep. 4, 2012

(54) FOGLESS MIRROR FOR A BATHROOM SHOWER AND BATHTUB SURROUND

(75) Inventors: Reid Christopher Sellgren, Minneapolis, MN (US); Robert Williams Verhey, Minneapolis, MN (US)

(73) Assignee: Newhome Bath & Mirror, Inc., Woodbury, MN (US)

Reexamination Request:
No. 90/011,696, Jun. 15, 2011

Reexamination Certificate for:

| | |
|---|---|
| Patent No.: | **6,420,682** |
| Issued: | **Jul. 16, 2002** |
| Appl. No.: | **09/709,789** |
| Filed: | **Nov. 3, 2000** |

Related U.S. Application Data

(60) Provisional application No. 60/219,851, filed on Jul. 21, 2000, and provisional application No. 60/163,200, filed on Nov. 3, 1999.

(51) Int. Cl.

| | |
|---|---|
| ***H05B 1/00*** | (2006.01) |
| ***H05B 3/00*** | (2006.01) |
| ***H05B 11/00*** | (2006.01) |

(52) U.S. Cl. ..... 219/219; 156/232

(58) Field of Classification Search ..... None
See application file for complete search history.

(56) References Cited

To view the complete listing of prior art documents cited during the proceeding for Reexamination Control Number 90/011,696, please refer to the USPTO's public Patent Application Information Retrieval (PAIR) system under the Display References tab.

*Primary Examiner*—Kevin Hurley

(57) ABSTRACT

A fogless heated mirror for incorporation into a shower surround, bathtub surround, whirlpool surround, sauna surround and any other similar surround that may be exposed to direct contact with water or a very high concentration of steam. The fog-free mirror 10 of the present invention for incorporation into a shower or tub surround 12 generally includes a mirror 14, a heater pad 16, and an electrical connection assembly 18.

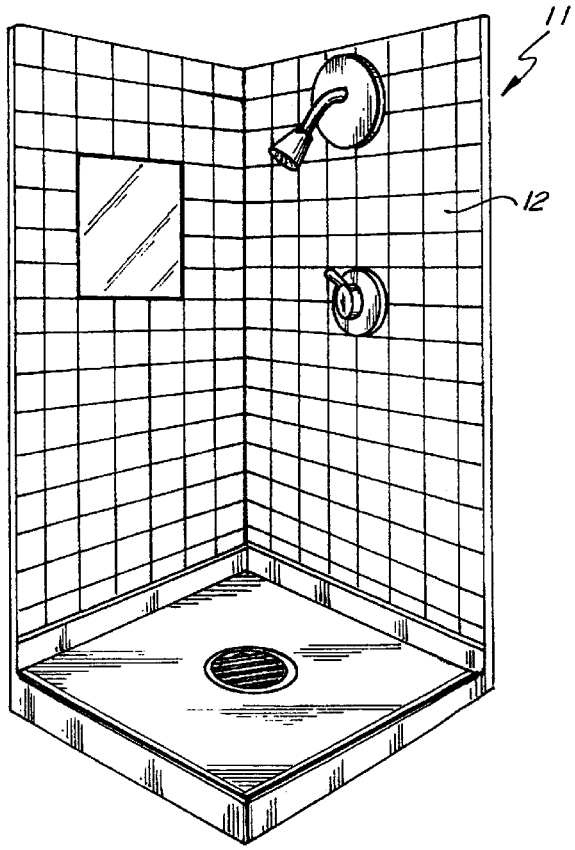

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 4, line 24:

*As illustrated in FIG. 2, the heating element 24 is arranged on the heater pad 16 so that electrical current is delivered to a central region of the heater pad 16 prior to a peripheral region of the heater pad 16 that extends around the central region. In the illustrated configuration, this result is accomplished by positioning the electrical connection assembly 18 in the central region.*

AS A RESULT OF REEXAMINATION, IT HAS BEEN DETERMINED THAT:

Claims 1 and 18 are determined to be patentable as amended.

Claims 2-5, 9 and 20, dependent on an amended claim, are determined to be patentable.

Claims 6-8, 10-17, 19 and 21 were not reexamined.

1. A fogless mirror shower assembly, comprising a shower surround including one or more fogless mirror assemblies; said fogless mirror assemblies comprising:

a mirror;

a heater pad adjoined to a back surface of the mirror, said heater pad including one or more heating elements and a moisture resistant insulation assembly, *wherein the heating element is arranged on the heater pad so that electrical current is delivered to a central region of the heater pad prior to a peripheral region of the heater pad that extends around the central region,* wherein said moisture resistant insulation assembly comprises two or more water resistant layers are fused together around the heating element to protect the heating element from moisture; and a water resistant electrical connection assembly including one or more moisture insulated conductor wires operably adjoined to the heating element and a power supply.

18. A method of installing a fogless mirror in a shower surround comprising:

fabricating a fogless mirror comprising a mirror, a heating pad, and a water resistant electrical connection assembly, wherein the heater pad is adjoined to a back surface of the mirror, wherein the heater pad includes one or more heating elements and a moisture resistant insulation assembly, *wherein the heating element is arranged on the heater pad so that electrical current is delivered to a central region of the heater pad prior to a peripheral region of the heater pad that extends around the central region* and wherein the water resistant electrical connection assembly includes one or more moisture insulated conductor wires operably adjoined to the heating element and a power supply;

measuring and marking a spot for installation of the fogless mirror on a wall of the shower surround;

creating an opening in the wall of the shower surround of a size sufficient to accommodate a portion of or the entire fogless mirror;

connecting the fogless mirror to the power supply;

securing the fogless mirror to the wall of the shower surround; and sealing the fogless mirror in relation to the wall of the shower surround to provide additional protection from undesired moisture.

* * * * *